US007392666B2

(12) United States Patent
Namiki

(10) Patent No.: US 7,392,666 B2
(45) Date of Patent: Jul. 1, 2008

(54) ACCESSORY AND METHOD OF MAKING THE SAME

(75) Inventor: Hiromasa Namiki, Kazo (JP)

(73) Assignee: Namiki Co., Ltd. (JP)

( * ) Notice: Subject to any disclaimer, the term of this patent is extended or adjusted under 35 U.S.C. 154(b) by 0 days.

(21) Appl. No.: 10/795,035

(22) Filed: Mar. 5, 2004

(65) Prior Publication Data

US 2004/0172970 A1 Sep. 9, 2004

(30) Foreign Application Priority Data

Mar. 6, 2003 (JP) ..... 2003-105848
Mar. 13, 2003 (JP) ..... 2003-002109

(51) Int. Cl.
*A44C 5/00* (2006.01)

(52) U.S. Cl. ..... 63/4; 63/38; 59/80; 59/83

(58) Field of Classification Search ..... 63/3, 63/3.1, 3.2, 4, 5.1, 5.2, 6–11, 35, 37; 245/1, 245/4, 6

See application file for complete search history.

(56) References Cited

U.S. PATENT DOCUMENTS 1,607,808 A * 11/1926 Anthony ..... 59/79.2
6,209,306 B1 * 4/2001 Chia et al. ..... 59/80
6,941,652 B2 * 9/2005 Echols et al. ..... 29/896.62

OTHER PUBLICATIONS

Namiki webpage http://www.namiki-net.com/en/catalog/035.html, published Jan. 11, 2003.*
Internet archive showing date of Namiki webpage.*

* cited by examiner

*Primary Examiner*—Jack W. Lavinder
(74) *Attorney, Agent, or Firm*—Harness, Dickey & Pierce, P.L.C.

(57) ABSTRACT

An accessory in the form of a metal-wire meshed tube body having a dual structure is provided wherein a metal-wire meshed tube body with fine mesh density is incorporated inside a metal-wire meshed tube body with coarse mesh density.

The accessory is provided in the form of a combination of a couple of meshed tube bodies formed by weaving metal wire to have respective different mesh density, wherein a dual-structure meshed tube body 3 is composed of a metal meshed tube body 1 with coarse mesh density positioned outwardly and a metal meshed tube body 2 with fine mesh density positioned inwardly.

2 Claims, 4 Drawing Sheets

ACCESSORY AND METHOD OF MAKING THE SAME

CROSS REFERENCE TO RELATED APPLICATIONS

The subject application is related to subject matter disclosed in Japanese Patent Application No. 2003-105848 filed on Mar. 6, 2003 and Japanese Utility Model Application No. 2003-2109, to which the subject application claims priority under Paris Convention and which are incorporated herein by reference.

BACKGROUND OF THE INVENTION

1. Field of the Invention

The present invention relates to an accessory and a method of making the same to provide protection against flattening and deformation caused by external pressure and to promote stabilization and diversification in color and design variation by combining a couple of meshed tube bodies formed by weaving specific metal wire, preferably precious metal wire such as gold, silver or platinum, to have respective different mesh density.

2. Related Background Art

Publicly known accessories, such as necklaces and bracelets, are made in the conventional technique in which specific precious metal wire such as gold, silver or platinum wire is weaved by a specific knitting machine to form a meshed tube body in a cylindrical shape, and metal rings and clasps fastened to the metal rings are attached to the respective ends of the meshed tube body.

Also, as stated in the official gazettes of Japanese Patent Application Publication Numbers 299514/1999 and 360320/2002, publicly known accessories are made in a manner that a precious-metal net which is formed by connecting ball chains made of precious metal is formed into a tubular shape, and a bead-like or string-like object or flexible object made of synthetic resin is inserted therein.

In the first one of the above-mentioned conventional techniques, i.e. the technique of weaving specific precious-metal wire such as gold, silver or platinum wire by a knitting machine to form a meshed tube body in a cylindrical shape, the problems are not only that external pressure is likely to cause a deformation, such as dent and flattening, of thus weaved precious-metal meshed tube body, but also that significant decorative effects cannot be achieved in terms of novel color and design.

In the second case on the other hand, i.e. either the techniques disclosed in the official gazettes of Japanese Patent Application Publication Numbers 299514/1999 or 360320/2002, precious-metal net is formed with precious-metal ball chains, and this precious-metal net is formed into a tubular shape. Since a net tube body made of precious metal has no resistance to deformation caused by external pressure and has no self-recovery characteristics, a bead-like or string-like object or flexible object made of synthetic resin is inserted into the net tube body to prevent flattening by external pressure. The net tube body is unable to keep its cylindrical shape for itself, which fact leads to the problem that use of different members increases the total cost and, moreover, causes difficulty of keeping definite form in color and design.

SUMMARY OF THE INVENTION

The purpose of the present invention is to provide an accessory that does not cause problems mentioned above. To provide protection from flattening and deformation caused by external pressure, an accessory according to the present invention is provided in the form of a dual-structured meshed tube body in which a meshed tube body to be positioned outwardly is formed with metal wires, preferably precious-metal wires such as gold, silver or platinum wires, to have coarse mesh density, and a meshed tube body to be positioned inwardly is formed to have fine mesh density. Said meshed tube body can provide significant and stable decorative effects in terms of color and design with low cost by changing the kind of metal wires of said meshed tube bodies respectively, changing components and/or component ratio of the alloy, or combining these alternatives, and by forming additional meshed tube body/bodies as necessary to increase the layers of a meshed tube body.

To accomplish the above purpose, an accessory according to the present invention is provided in the form of a combination of a couple of meshed tube bodies which are formed by weaving metal wires to have different respective mesh density, and is characterized by being a dual-structure meshed tube body formed by positioning a meshed tube body with coarse mesh density outwardly and positioning a meshed tube body with fine mesh density inwardly.

Said meshed tube body with coarse mesh density can be a meshed tube body with a single-link mesh formed by weaving metal wires to cast single links into a cylindrical shape, and said meshed tube body with fine mesh density can be a meshed tube body with a double-link mesh formed by weaving metal wires to cast double links into a cylindrical shape.

Said metal wires are preferably precious-metal wires including gold, silver and platinum.

Said metal wires can be alloy wires in which components and component ratio are altered.

At least one of said dual-structured meshed tube body can be formed by weaving a plurality of metal wires of different metal kinds, a plurality of alloy wires containing different components or having different component ratio, or a plurality of metal wires in combination therewith.

A meshed tube body can have a multi-layered structure that is dual or more by adding additional meshed tube body/bodies.

Said meshed tube body positioned inwardly can be stretched longitudinally so that the mesh density can become denser and the strength can be increased correspondingly.

Said meshed tube body positioned outwardly can be stretched longitudinally for closer fit between said inwardly and outwardly positioned meshed tube bodies.

A method of making an accessory according to the present invention comprises the step of: weaving metal wires to form a meshed tube body having a relatively small diameter and relatively fine mesh density; weaving metal wires to form a meshed tube body having a relatively large diameter and relatively coarse mesh density; and inserting said meshed tube body having a relatively small diameter and relatively fine mesh density into said meshed tube body having a relatively large diameter and relatively coarse mesh density.

The method of making an accessory according to the present invention can further comprise the step of stretching said meshed tube body having a relatively small diameter and relatively fine mesh density so that the mesh becomes denser.

The method of making an accessory according to the present invention can further comprise the step of stretching said meshed tube body having a relatively large diameter and relatively coarse mesh density so that the internal diameter is lessen.

A method of making an accessory according to the present invention comprises the step of: weaving metal wires to form a couple of meshed tube bodies; stretching one of said couple of meshed tube bodies so that the mesh becomes denser; and inserting said stretched meshed tube body into the other meshed tube body.

The present invention is excellent in strength in comparison with the conventional precious-metal net tube body due to a meshed tube body having a dual structure formed in a manner that a precious-metal meshed tube body with coarse mesh density and a precious-metal meshed tube body with fine mesh density are formed by weaving metal wires, and said meshed tube body with fine mesh density is incorporated inside said meshed tube body with coarse mesh density. Especially by densifying the mesh of said incorporated meshed tube body as necessary, said meshed tube body can be a robust metal-mesh tubular core body and thereby sufficiently preventing flattening and deformation caused by external pressure, according to the present invention.

Furthermore, the outwardly positioned meshed tube body is coarse and thereby decreasing the cost for materials.

Moreover, decorative effects that are inevitable for accessories are significantly increased because both of said meshed tube bodies are formed by weaving metal wires to provide mutual harmonization without being odd and without losing characteristics of the unique design of a meshed tube body made of precious-metal wires.

In addition to the fact that the inwardly positioned and outwardly positioned meshed tube bodies are formed by weaving metal wires to provide mutual and integral harmonization, the meshed tube body positioned inwardly can be longitudinally pulled to a proper extent to be contracted toward the center of the tube body so that the mesh density of the meshed tube body inwardly positioned can become denser and thus the strength can be increased correspondingly.

An alternative can be that a couple of meshed tube bodies are formed by weaving metal wires, and one of the meshed tube body is stretched so that the mesh becomes denser with the external diameter smaller, and then the stretched meshed tube body is inserted into the other meshed tube body.

Another alternative can be that the meshed tube body positioned outwardly is longitudinally pulled to a proper extent so that the external diameter can be contracted toward its center and thus the inwardly and outwardly positioned meshed tube bodies can be adjusted to have appropriately closer fit.

Furthermore, a wide range of color diversification can be provided over the entire meshed tube body by properly changing the metal kind of the metal wires, the components and/or component ratio of the alloy, or the combination thereof.

Also, regarding the meshed tube body positioned inwardly, the meshed tube body positioned outwardly, or the both thereof, a wide range of color diversification can be provided to each meshed tube body by weaving each meshed tube body with a plurality of metal wires of different metal kinds, with a plurality of alloy wires of different components and/or component ratio, or with a plurality of metal wires in combination therewith. In this case, a multi-layered structure results in offering significant decorative effects for the entire meshed tube body.

According to the present invention, a meshed tube body is formed to have a multi-layered structure that is dual or more with additional meshed tube body/bodies so that a meshed tube body with significant decorative effects can be provided with complicated colors leading to the diversification of the entire color and design variation.

According to the method of making an accessory of the present invention, by weaving metal wires to form a meshed tube body having a relatively small diameter and relatively fine mesh density and a meshed tube body having a relatively large diameter and relatively coarse mesh density, and inserting the former into the latter, a accessory preventing flattening and deformation caused by external pressure with various design can be achieved at a low cost.

Further, by stretching the meshed tube body having a relatively small diameter and relatively fine mesh density after inserting, the stretched meshed tube body becomes a core which has sufficient strength to prevent flattening and deformation caused by external pressure.

By stretching the meshed tube body having a relatively large diameter and relatively coarse mesh density after inserting, the stretched mesh tube body fits the inner mesh tube body.

By weaving metal wires to form a couple of meshed tube bodies, stretching one of said couple of meshed tube bodies and inserting said stretched meshed tube body into the other meshed tube body, it can be easily obtain an accessory with a dual-structured meshed tube body of different mesh densities.

DESCRIPTION OF THE PREFERRED EMBODIMENTS

Specific embodiments of an accessory according to the present invention will be hereinafter explained in detail with reference to the drawings.

Figure 1:
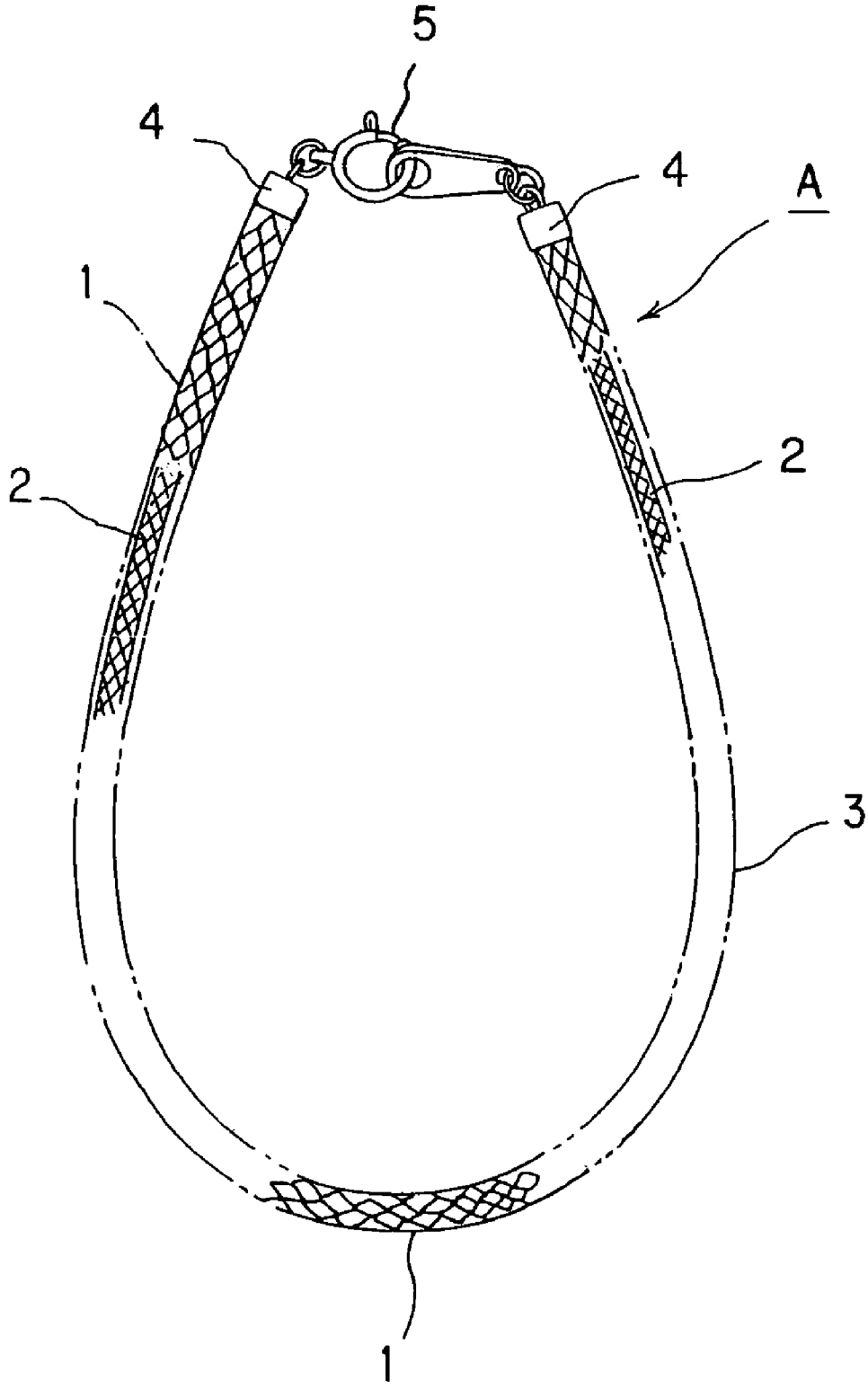
FIG. 1 is a view, partly broken away, of a necklace according to an embodiment of the present invention.

FIG. 1 illustrates a necklace to exemplify the embodiments of the accessory according to the present invention. The necklace is an accessory provided in the form of a dual-structured precious-metal meshed tube body 3 which comprises: a precious-metal meshed tube body 1 formed by weaving precious-metal wires such as gold wires, silver wires or platinum wires to have coarse mesh density; and a precious-metal meshed tube body 2, to be inserted into this precious-metal meshed tube body 1, formed by weaving precious-metal wires such as gold wires, silver wires or platinum wires to have finer mesh density than that of said precious-metal meshed tube body 1.

Regarding the precious-metal meshed tube body 1 and 2, any form and dimensions are adaptable as long as the size (form and dimensions) of the mesh density of the precious-metal meshed tube body 1 positioned outwardly is coarse and that of the precious-metal meshed tube body 2 positioned inwardly is fine. One or more additional mesh tube bodies 2*a* can also be provided.

Additionally, the dimensions including the lengths and the diameters of the precious-metal meshed tube body 1 positioned outwardly and the precious-metal meshed tube body 2 positioned inwardly are preferably the sizes for both the meshed tube bodies to be appressed against each other or fit each other allowing some play in space, but not limited to these configurations.

While precious-metal wires have been exemplified as metal wires in the present embodiment, the metal wires are not limited to precious-metal wires but can include any metal wire having decorative effect.

Figure 2:
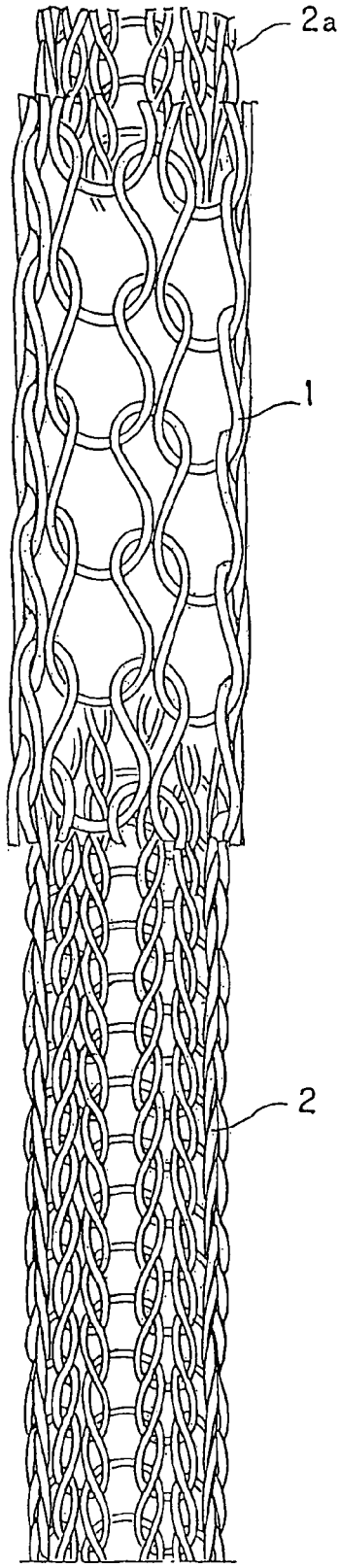
FIG. 2 is an enlarged view, partly broken away, of a necklace according to an embodiment of the present invention.
Figure 3:
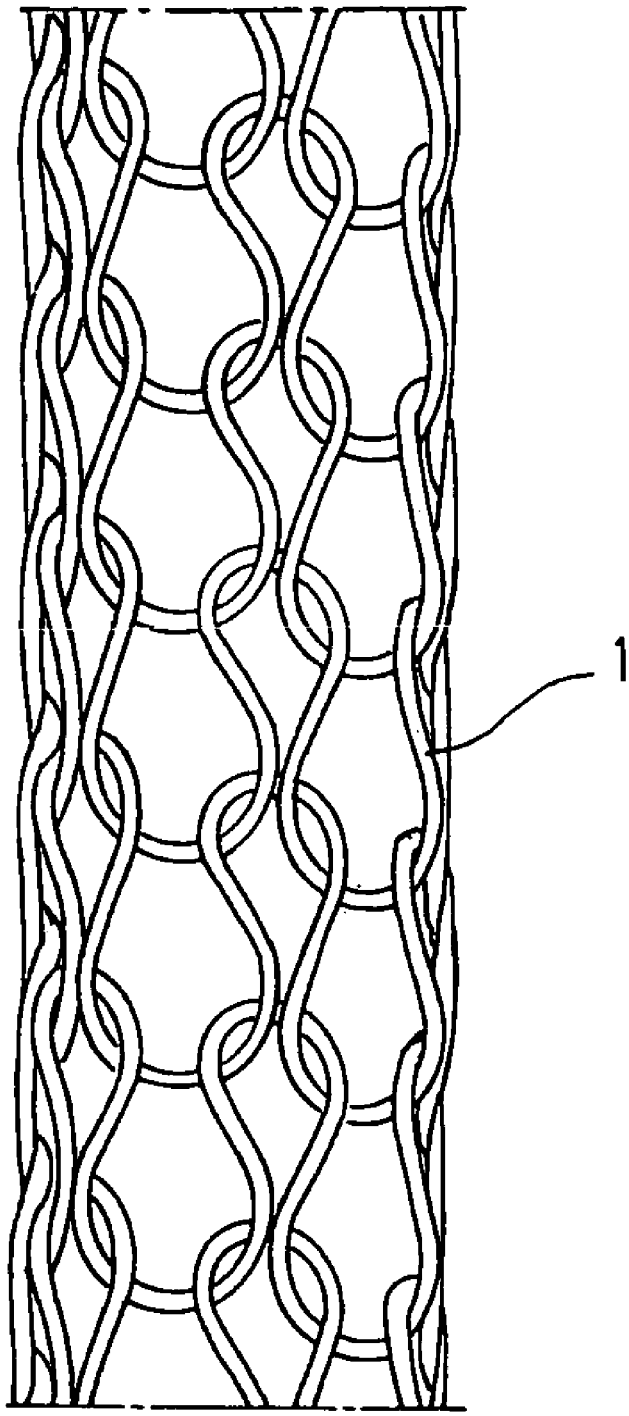
FIG. 3 is an enlarged front-elevational view of a meshed tube body to be positioned outwardly.
Figure 4:
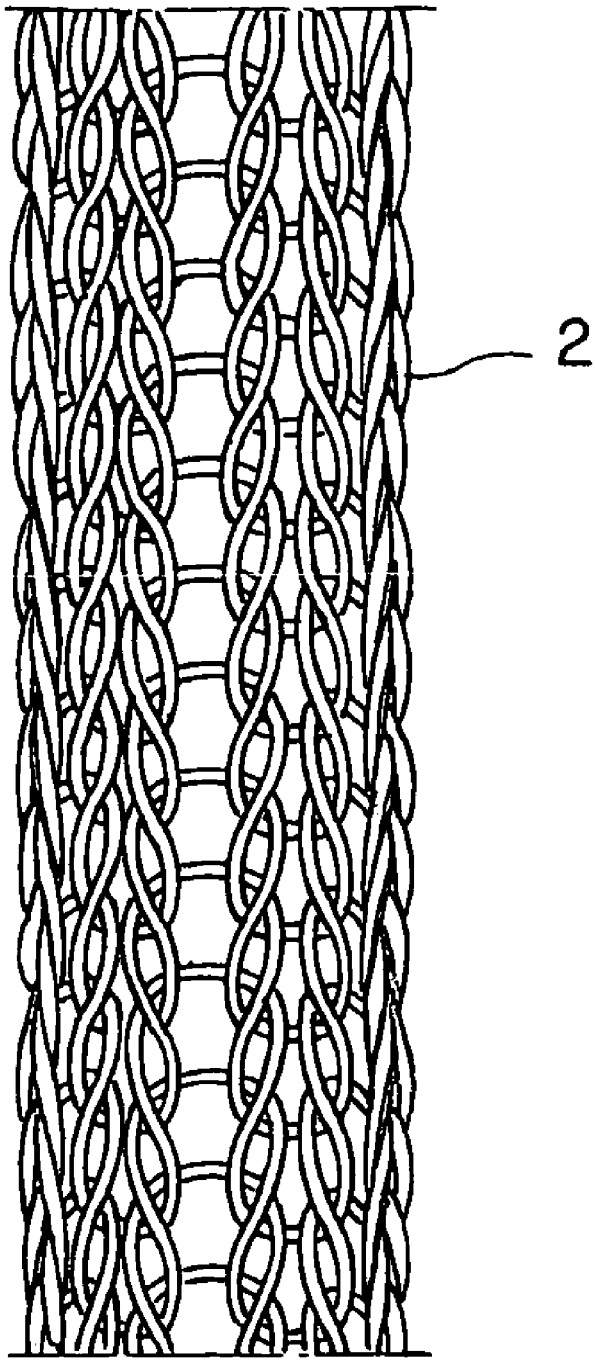
FIG. 4 is an enlarged front-elevational view of a meshed tube body to be positioned inwardly.

FIG. 2 is an enlarged view of a necklace exemplifying the embodiments of the accessory according to the present invention, wherein the precious-metal meshed tube body 1 to be positioned outwardly is formed into a precious-metal meshed tube body with a coarse single-link mesh by weaving specific precious-metal wires to cast single links into a cylindrical shape, using a well-known knitting machine (not shown), and the precious-metal meshed tube body 2 to be positioned inwardly, which is to be incorporated inside the precious-metal meshed tube body 1 that is to be positioned outwardly, is formed into a precious-metal meshed tube body with a fine double-link mesh by weaving specific precious-metal wires to cast double links into a cylindrical shape, using a well-known knitting machine (not shown) as well, and thus the accessory in the form of a dual-structured precious-metal meshed tube body 3 is provided.

Regarding the precious-metal meshed tube body 1 and 2, any form and dimensions are adaptable as long as the size (form and dimensions) of the mesh of the precious-metal meshed tube body 1 positioned outwardly is coarse and that of the precious-metal meshed tube body 2 positioned inwardly is fine.

The outwardly and inwardly positioned precious-metal meshed tube bodies 1 and 2 are appressed each other to establish a dual structure, although the configuration is not necessarily limited to the appressed state, so that the accessory comprising the precious-metal meshed tube bodies can have resistance to flattening and deformation caused by external pressure.

Furthermore, the outwardly and inwardly positioned precious-metal meshed tube bodies 1 and 2 are flexible as a result of weave fabrication, and consequently the dual-structured precious-metal meshed tube body 3 can be bended easily to be suitable for an accessory such as a necklace, bracelet, etc.

Also, a wide range of color diversification can be offered by respectively changing the metal kind or components and/or component ratio of the alloy of, or by combining these alternatives in, gold, silver or platinum wires which is weaved into the precious-metal meshed tube bodies 1 and 2. Moreover, a wide variety of colorful designs can be provided over the entire meshed tube body by using a plurality of metal wires of different metal kinds, a plurality of alloy wires of different components and/or component ratio, or a combination thereof within a single meshed tube body.

The meshed tube body can achieve further diversification of design variation by adding additional meshed tube body/bodies to provide a meshed tube body having a multi-layered structure that is dual or more.

As shown in FIG. 2, the precious-metal meshed tube body 2 to be positioned inwardly can be pulled longitudinally so that its external diameter is contracted and concentrated toward its center, and thereby the mesh density becomes denser and the strength is increased correspondingly, and in this manner the precious-metal meshed tube body 2 can be a core of the precious-metal-mesh tube body as a result.

As an alternative, the precious-metal meshed tube body 1 to be positioned outwardly can be pulled longitudinally so that its external diameter can be contracted and concentrated toward its center, and thereby the inwardly and outwardly positioned precious-metal meshed tube bodies 1 and 2 can be adjusted to have appropriate fit conditions.

Moreover, the reference numeral 4 shown in FIG. 1 represents metal rings attached to the respective ends of the dual-structured precious-metal meshed tube body 3, and both the inwardly and outwardly positioned precious-metal meshed tube bodies 1 and 2 also are attached integrally to these metal rings at the respective ends. The reference numeral 5 represents clasps fastened to the metal rings 4.

What is claimed is:

1. An accessory provided in the form of a combination of meshed tube bodies which are formed of woven metal wires so that the meshed tube bodies have a different respective mesh density, characterized by being a dual-structured meshed tube body including an outer meshed tube body with coarse mesh density and an inner meshed tube body with fine mesh density that is less than the coarse mesh density, and the inner meshed tube body positioned within the outer meshed tube body, wherein said outer meshed tube body with coarse mesh density is a meshed tube body with a single-link mesh including a metal wire forming woven single links into a cylindrical shape; and wherein said inner meshed tube body with fine mesh density is a meshed tube body with a double-link mesh including a metal wire forming woven double links into a cylindrical shape.

2. A jewelry accessory provided in the form of a combination of meshed tube bodies which are formed of woven metal wires so that the meshed tube bodies have a different respective mesh density, characterized by being a dual-structured meshed tube body including an outer meshed tube body with coarse mesh density and an inner meshed tube body with fine mesh density that is less than the coarse mesh density, and the inner meshed tube body positioned within the outer meshed tube body, and further characterized by at least one additional meshed tube body positioned between the inner meshed tube body and the outer meshed tube body.

* * * * *